US008807724B2

(12) United States Patent
Lu et al.

(10) Patent No.: US 8,807,724 B2
(45) **Date of Patent: *Aug. 19, 2014**

(54) REPLACEABLE INK BAG AND INK CARTRIDGE WITH REPLACEABLE INK BAG

(71) Applicant: JetBest Corporation, Hsinchu (TW)

(72) Inventors: Yi-Ching Lu, Hsinchu (TW); Ming-Chung Peng, Hsinchu (TW)

(73) Assignee: JetBest Corporation, Hsinchu (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/063,419

(22) Filed: Oct. 25, 2013

(65) Prior Publication Data

US 2014/0176649 A1 Jun. 26, 2014

Related U.S. Application Data

(63) Continuation-in-part of application No. 13/784,470, filed on Mar. 4, 2013, now Pat. No. 8,608,299.

(30) Foreign Application Priority Data

Dec. 21, 2012 (TW) ..... 101149144 A

(51) Int. Cl.
*B41J 2/175* (2006.01)

(52) U.S. Cl.
CPC ..... *B41J 2/17553* (2013.01)
USPC ..... 347/86

(58) Field of Classification Search
USPC ..... 347/84–87
See application file for complete search history.

(56) References Cited

U.S. PATENT DOCUMENTS

| | | | | |
|---|---|---|---|---|
| 6,375,316 | B1 | 4/2002 | Okubo et al. | |
| 6,908,182 | B2 | 6/2005 | Nakazawa et al. | |
| 7,097,294 | B2 | 8/2006 | Ishizawa et al. | |
| 7,677,712 | B2 | 3/2010 | Ishizawa et al. | |
| 8,608,299 | B1 * | 12/2013 | Lu et al. | 347/86 |
| 2008/0303881 | A1 | 12/2008 | Hibbard et al. | |
| 2011/0057997 | A1 | 3/2011 | Takeuchi | |
| 2011/0134197 | A1 | 6/2011 | Ishizawa et al. | |

* cited by examiner

*Primary Examiner* — Kristal Feggins
(74) *Attorney, Agent, or Firm* — Rabin & Berdo, P.C.

(57) ABSTRACT

A replaceable ink bag and an ink cartridge with replaceable ink bag are provided. The ink bag includes an ink amount trigger, a bag body and a positioning element. The two opposite sides of the bag are partially adhered with the ink amount trigger and the positioning element respectively. The ink cartridge includes a cartridge body, an ink bag and a lid body. The lid body is removably engaged to the cartridge body to house the ink bag. The wall on long side of the cartridge includes at least a retention block. The surroundings of the positioning element of the ink bag are disposed with at least a retention element. The retention element can be inserted between the retention block and the bottom of the cartridge body for fixing the ink bag inside the cartridge.

10 Claims, 9 Drawing Sheets

REPLACEABLE INK BAG AND INK CARTRIDGE WITH REPLACEABLE INK BAG

CROSS-REFERENCES TO RELATED APPLICATIONS

This is continuation-in-part application of U.S. application Ser. No. 13/784,470, filed Mar. 4, 2013, which claims the benefit of Taiwan Patent Application No. 101149144, filed Dec. 21, 2012, which is incorporated by reference.

FIELD OF THE INVENTION

The present invention generally relates to an ink bag and an ink cartridge technique field, and more specifically to a replaceable ink bag and an ink cartridge with replaceable ink bag to improve reusability.

BACKGROUND OF THE INVENTION

The commercially used inkjet printer often uses ink cartridge with capacity up to 4000 ml. To avoid occupying too much space when the ink cartridge is installed in the printer, the ink cartridge is usually designed as a long shape with the ratio of length vs. width as high as six to one. A collapsible ink bag is included inside this type of ink cartridge, and is responsible for supplying a large amount of ink continuously.

To ensure that the user is alerted of the time of running output ink and to change the cartridge, one side of the ink bag is partially glued to the inner bottom of the cartridge, and the other side of the ink bag is disposed with a trigger based on the remaining ink amount. The trigger can move towards a specific direction as the amount of ink reduces and the ink bag shrinks or flattens. The specific direction is towards the side glued to the bottom of the cartridge. When the trigger touches a sensor in the printer, the printer will issue an alert for replacing the cartridge to inform the user. Because of the trigger, the bottom of the ink bag must also be attached to the bottom of the cartridge, which leads to difficulty in replacing the ink bag. Hence, the commercial large-size ink cartridge is often a disposable product. The entire cartridge must be replaced when the ink is exhausted, instead of simply replacing the ink bag. As a result, the purchase cost is higher and the discarded cartridge cause extra environmental burden and resource waste. Thus, it is imperative to devise a solution to the above shortcomings of the known technique.

SUMMARY OF THE INVENTION

The primary object of the present invention is to provide a replaceable ink bag, which targets at ink bag with ink amount trigger, by gluing a long strip of positioning element to the other side of the ink bag and the positioning element for closing or disengaging the ink cartridge to overcome the shortcoming of conventional ink cartridge unable to replace the ink bag.

Another object of the present invention is to provide an ink cartridge with replaceable ink bag, designed to match specifically the aforementioned ink bag, convenient for replacing an internal ink bag when running out of ink, applicable to ink cartridge disposed with trigger based on the amount of remaining ink.

To achieve the above object, the ink bag of the present invention includes an ink amount trigger, a bag body, and a positioning element. The bag body can be a bag container with changeable shape, filled with ink. The bag body includes a first bag surface and a second bag surface, disposed oppositely. The first bag surface is partially glued to the ink amount ink amount trigger, and the ink amount trigger moves in a predefined direction as the amount of remaining ink reduces. The second bag surface is partially glued to the positioning element. When assembled, the positioning element is responsible for stopped inside the matched ink cartridge.

Furthermore, the ink bag can be used with different cartridge body and lid body to become an ink cartridge with replaceable ink bag. The ink cartridge of the present invention includes an cartridge body, an ink bag and a lid body. The cartridge is a hard-shell container with an opening. The wall on long side of the cartridge includes at least a retention block. The ink bag further includes an ink amount trigger, a bag body, and a positioning element. The bag body can be a bag container with changeable shape, filled with ink. The bag body includes a first bag surface and a second bag surface, disposed oppositely. The first bag surface is partially glued to the ink amount ink amount trigger, and the ink amount trigger moves in a predefined direction as the amount of remaining ink reduces. The second bag surface is partially glued to the positioning element. The surroundings of the positioning element are disposed with at least a retention element. The retention element can be inserted between the retention block and the bottom of the cartridge body for fixing the ink bag inside the cartridge. The lid body is removably engaged to the cartridge body to open or close the opening so that the ink bag is fixed inside the container formed by the cartridge body and the lid body.

With the present invention, the ink bag can be easily installed inside the cartridge body and is easy to replace. For actual operation, the ink bag is placed into the cartridge body from above and is moved laterally in a short distance to fix the ink bag inside the cartridge body. The lid body is then placed over the cartridge body to cover the opening to accomplish the assembly. To retrieve the empty ink bag, the above process is reversed. The present invention is a simple and convenient design.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

The present invention is a replaceable ink bag, and an ink cartridge designed to match the replaceable ink bag to meet the requirements of the ink printer users.

Figure 1:
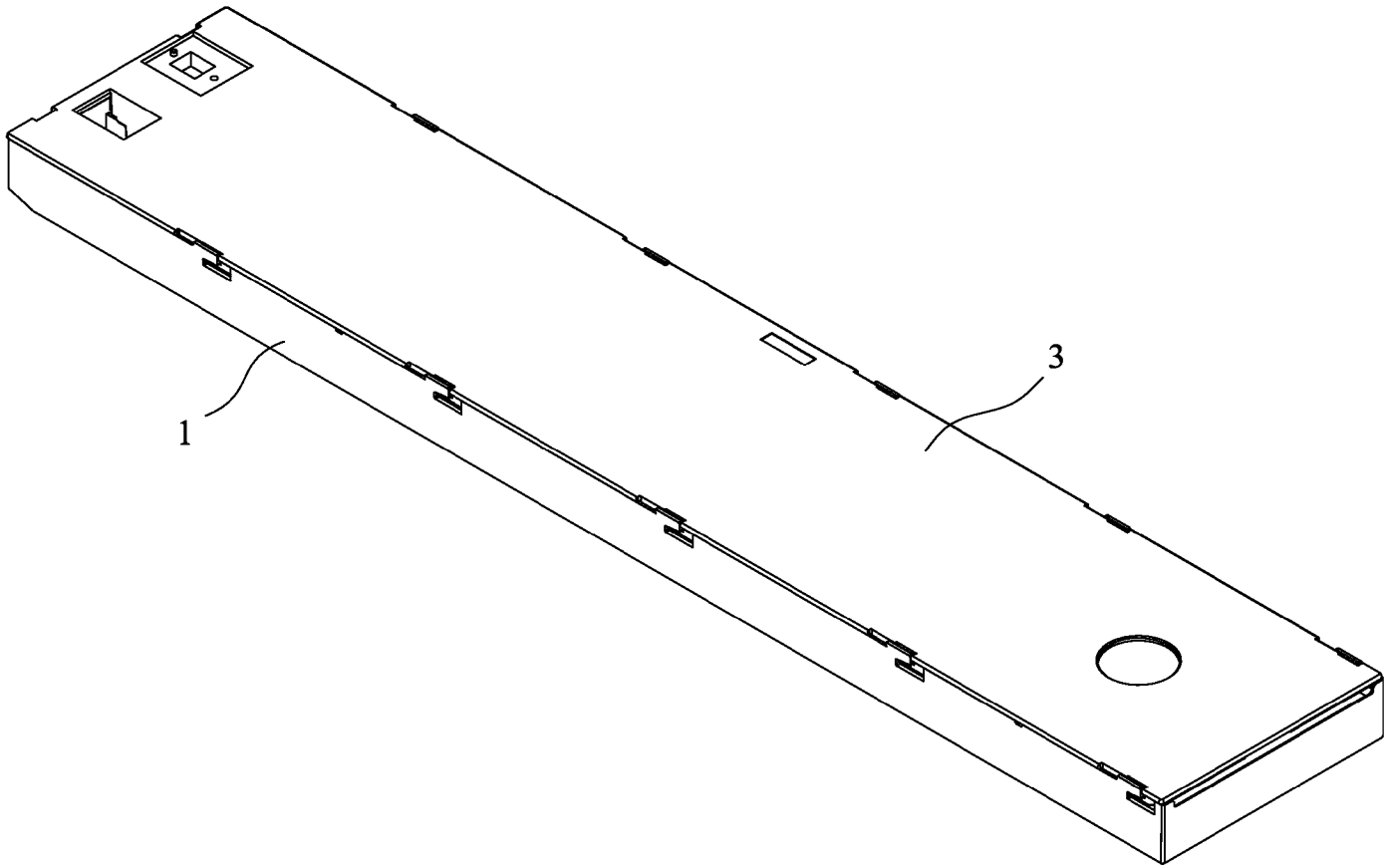
FIG. 1 shows a schematic view according to the present invention.
Figure 2:
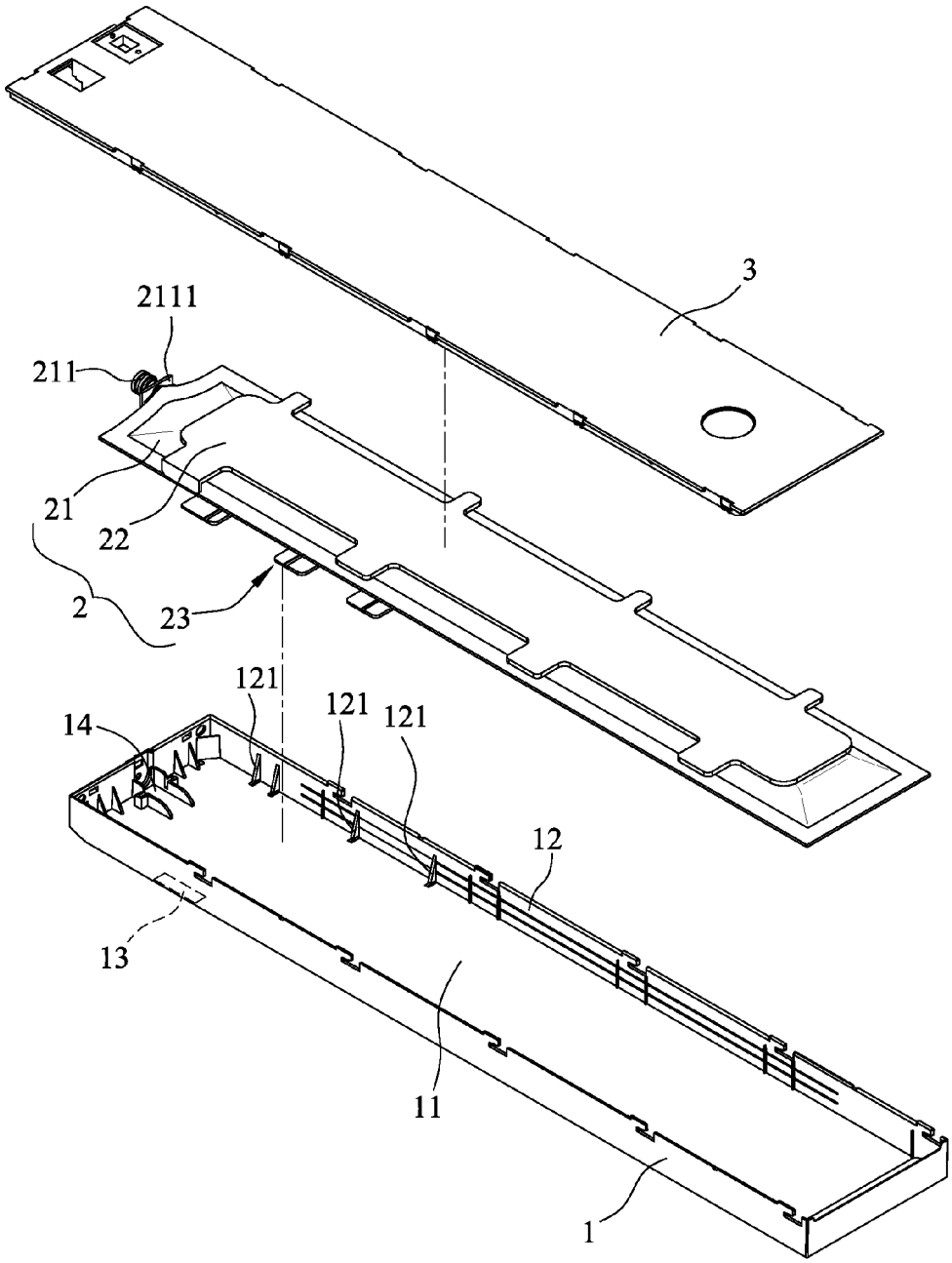
FIG. 2 shows a dissected view according to the present invention.

FIG. 1 and FIG. 2 respectively show a schematic view and a dissected view according to the invention. The ink cartridge with replaceable ink bag includes a cartridge body 1, an ink bag 2 and a lid body 3. The shape of the ink cartridge is a long rectangular box formed by the cartridge body 1 and the lid body 3 for housing ink bag 2. A wall 12 on the long side of the cartridge body 1 includes at least a retention block 121. When assembled, the retention block 121 is for fixing the position of the ink bag 2. To replace the ink bag 2, the ink bag 2 slides laterally off the stuck position by the retention block 121 for replacement.

Figures 3A, 3B:
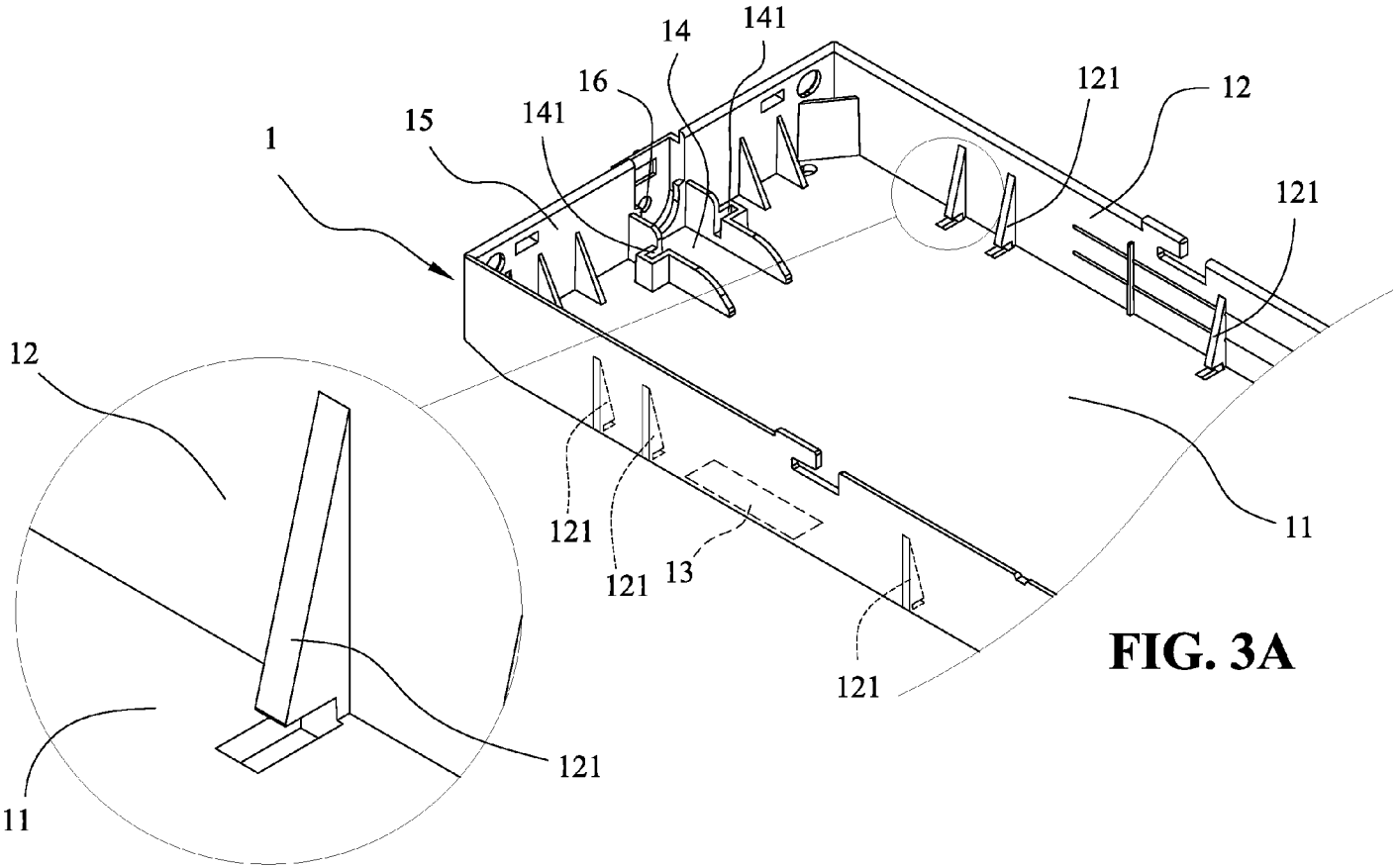
FIG. 3A shows a partially enlarged view of the cartridge body.
FIG. 3B shows a partially enlarged view of FIG. 3A.

The following describes each element in details. As shown in FIG. 2, FIG. 3A and FIG. 3B, the cartridge body 1 is a hard-shell container with an upward opening and shaped as a long rectangular box for housing the ink bag 2. The retention block 121 is located on the wall 12 on long side of the cartridge body 1. In the present embodiment, the opposite walls 12 on the long side inside the shell are both disposed with a plurality of retention block 121, disposed with intervals. The retention block 121 has a shape similar to a right triangle, with an acute angle pointing upward towards the opening of the cartridge body 1. A gap exists between the retention block 121 and the bottom surface 11 of the cartridge body 1, for latching the ink bag 2.

Figure 4:
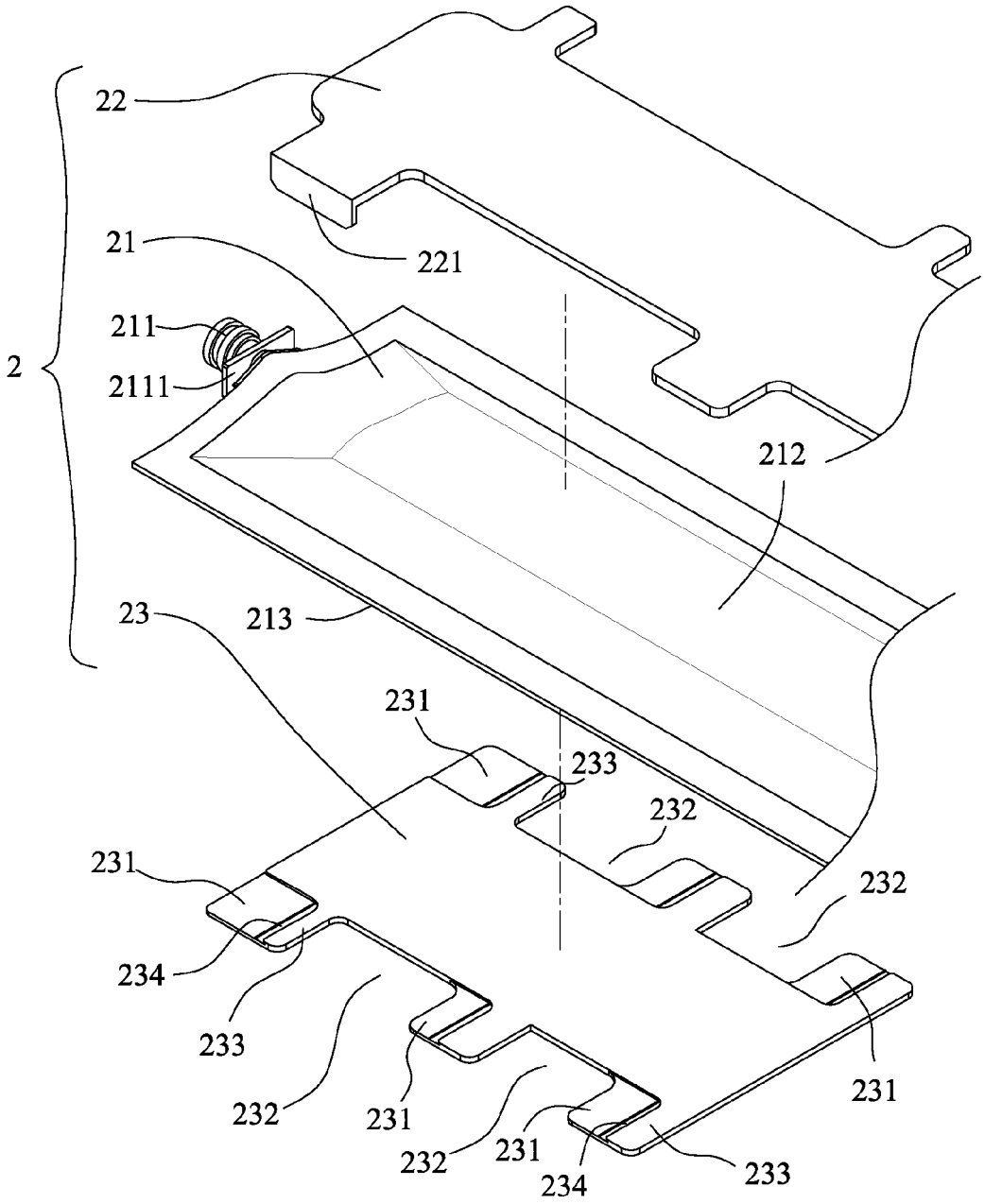
FIG. 4 shows a dissected enlarged view of the ink bag according to the present invention.

As shown in FIG. 2 and FIG. 4, the ink bag 2 includes a bag body 21, an ink amount trigger 22 and a positioning element 23. The shape of the bag body 21 is changeable. The bag body 21 is filled with ink. The bag body provides an ink supply connector, for connecting to the tube of a printer to supply ink. The ink supply connector 211 is not restricted to any specific shape, and can be changed to match the printer. In the present embodiment, the ink supply connector 211 includes a protruding piece 2111, for correctly positioning inside the cartridge body 1 when assembled. The bag body 21 is a long rectangular bag, including a first bag surface 212 and a second bag surface 213, disposed oppositely. The ink amount trigger 22 is glued to the first bag surface 212, and the positioning element 23 is glued to the second bag surface 213. The ink amount trigger 22 and the positioning element 23 are both glued to an area of surface on the bag body 21, and will not prevent the bag body 21 from expanding caused by filling ink. The ink amount trigger 22 is a signal trigger to indicate the condition of running out of ink. A long side of the ink amount trigger 22 includes a downward touch piece 221. The touch piece 221 will not contact the positioning element 23 during the downward moving path. As such, when the amount of remaining ink in the ink bag 2 reduces, the bag body 21 also shrinks to become flattened, and the ink amount trigger 22 moves in a predefined direction. In the present embodiment, the direction is towards the inner bottom 11 of the cartridge body 1. The inner bottom 11 of the cartridge body 1 includes a hole 13 so that the touch piece 221 can extends beyond the ink cartridge 1 through the hole 13 to contact a sensor of the printer when the ink amount trigger 22 is lowered to the bottom. The printer can then display a message of low ink. The positioning element 23 is responsible for fixing the ink bag 2 inside the ink cartridge 1. The positioning element 23 is a thin plate of a long rectangular shape, glued to the second bag surface 213 of the bag body 21. The positioning element has a length of at least ¼ of the bag body 21, which is only for illustrative purpose of the exemplar. The surroundings of the positioning element 23 include at least a retention element 231. In the present embodiment, three retention elements 231 are disposed on each of the two opposite long sides of the positioning element 231. A notch 232 exists between two adjacent retention elements 231. The position of each notch 232 corresponds to the location of the retention block 121. The retention element 231 further includes a stop block 233 and a positioning trench 234. The height of the surface of the retention element 231 is higher than the trench bottom of the positioning trench 234 and lower than the top of the stop block 233. The stop block 233 has a thickness exceeds the gap between the retention block 121 and the inner bottom 11, for preventing the positioning element 23 to slide off the predefined position. The function of the positioning trench 234 is to for the retention block 121 to slide into the positioning trench 234 when assembled for temporary fixing. In the present embodiment, the positioning trench 234 is near the stop block 233. The thickness of the retention element 231 is close to but less than the gap between the retention block 121 and inner bottom 11.

In addition, to ensure the ink supply connector 211 of the ink bag 2 to correctly fixed to the cartridge body 11, a base 14 (shown in FIG. 2 and FIG. 3A) is included inside the cartridge body 1. The base 14 is near a wall 15 on the short side of the cartridge body 1. The base 14 has a shape matching the shape of the ink supply connector 211. Thus, in the present embodiment, the base 14 further includes a engaging notch 141 for the insertion of the protruding piece 2111. The short side wall 15 further includes an insertion hole 16, located correspondingly to the base 14. When assembled, the ink supply connector 211 of the ink bag 2 is stuck inside the base 14, and the insertion hole 16 is located at the center of the end surface of the ink supply connector 211. As such, a pin of the tube of the printer can insert into the ink supply connector 211 inside the cartridge body 1 to facilitate the ink outflow.

Figure 5:
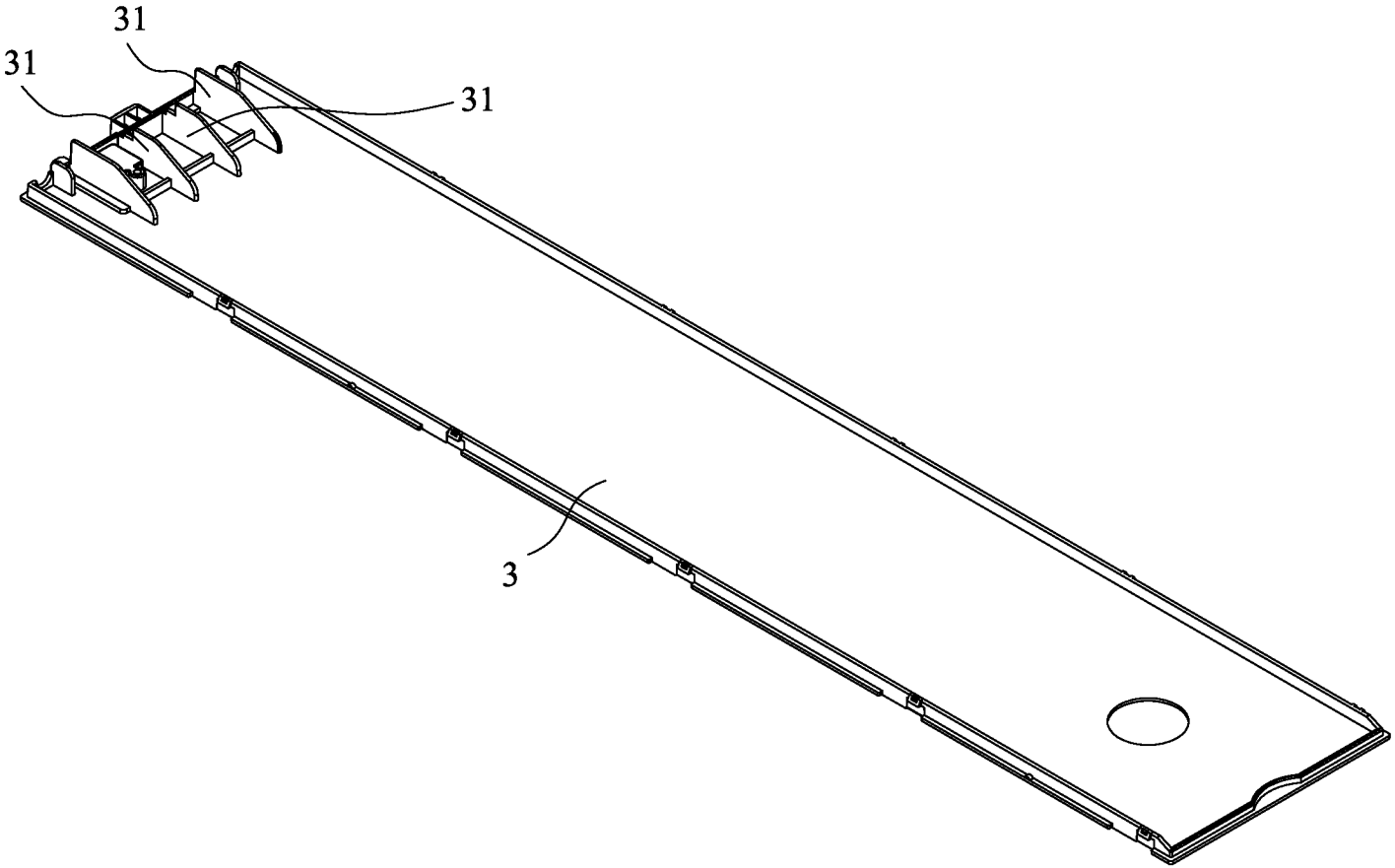
FIG. 5 shows a schematic view of the lid body of the present invention from a different angle.

As shown in FIG. 2 and FIG. 5, the lid body 3 of the present invention is removably engaged to the cartridge body 1 for opening and closing of the cartridge body 1. The engagement can be by different means, for example, notch and latch, or the lid body 3 coupled to the cartridge body on one side and a buckle on the other side. The present invention is not restricted to the engagement means. A set of pressers 31 is included inside the lid body 3. The presser 31 matches the base 14 inside the cartridge body 1, for fixing the location of the ink supply connector 211 and the surface of the bag body 21 to facilitate smooth ink supply. The base 14 has a structure matching the ink supply connector 211, and is not restricted to any specific shape.

Figure 6:
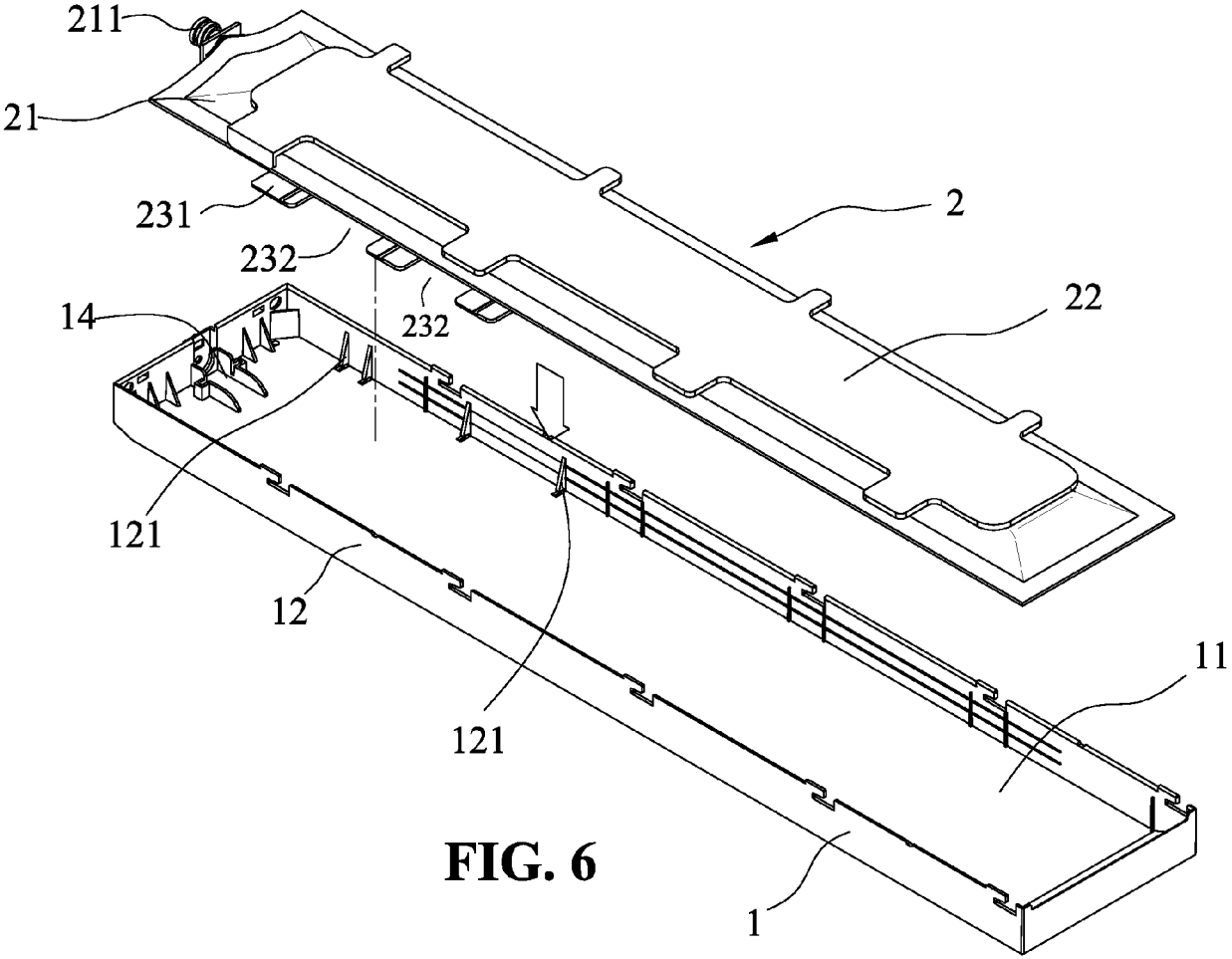
FIG. 6 shows a schematic view of placing the ink bag into the cartridge body.
Figure 7:
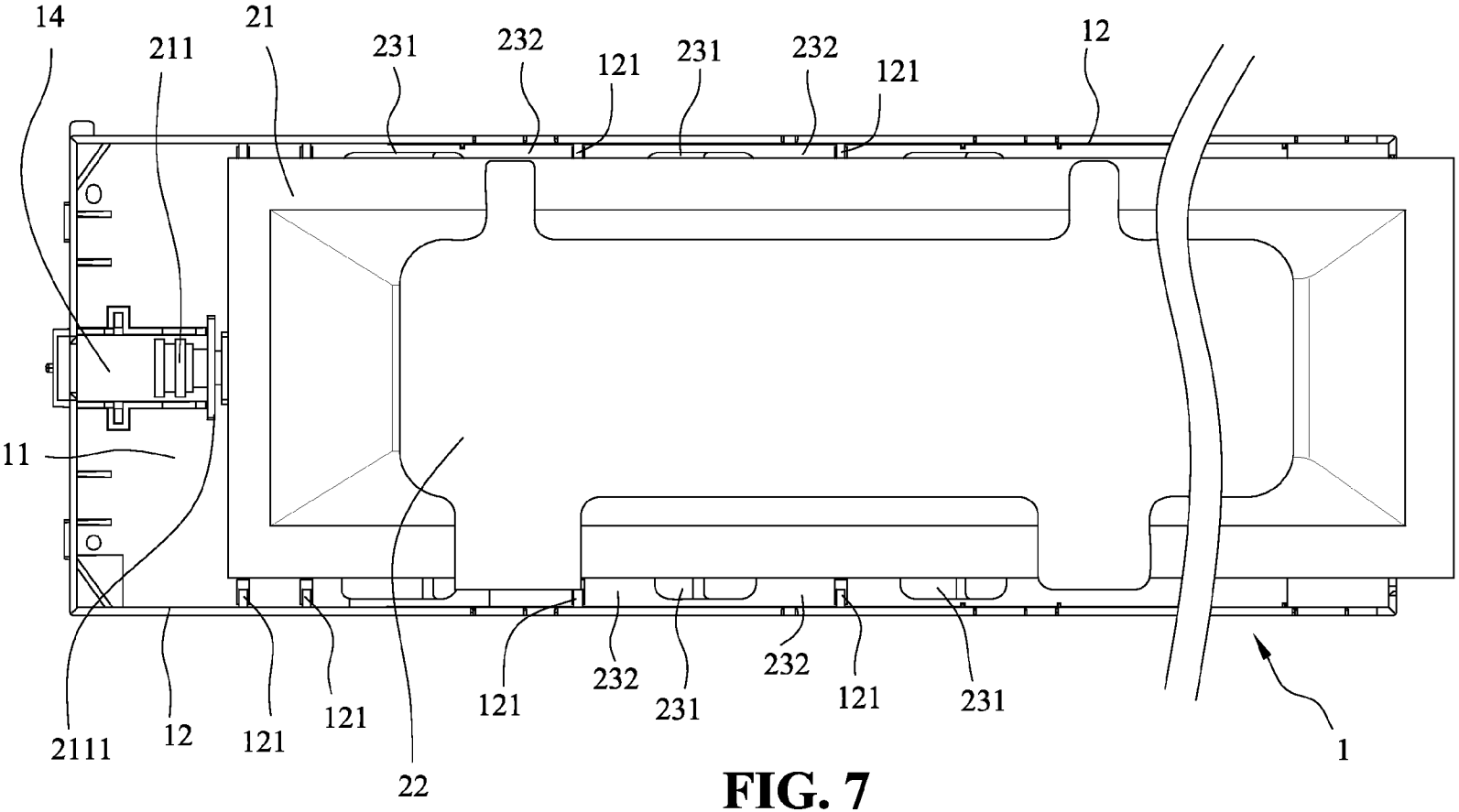
FIG. 7 shows an enlarged view of the ink bag placed into the cartridge before moving according to the present invention.
Figure 8:
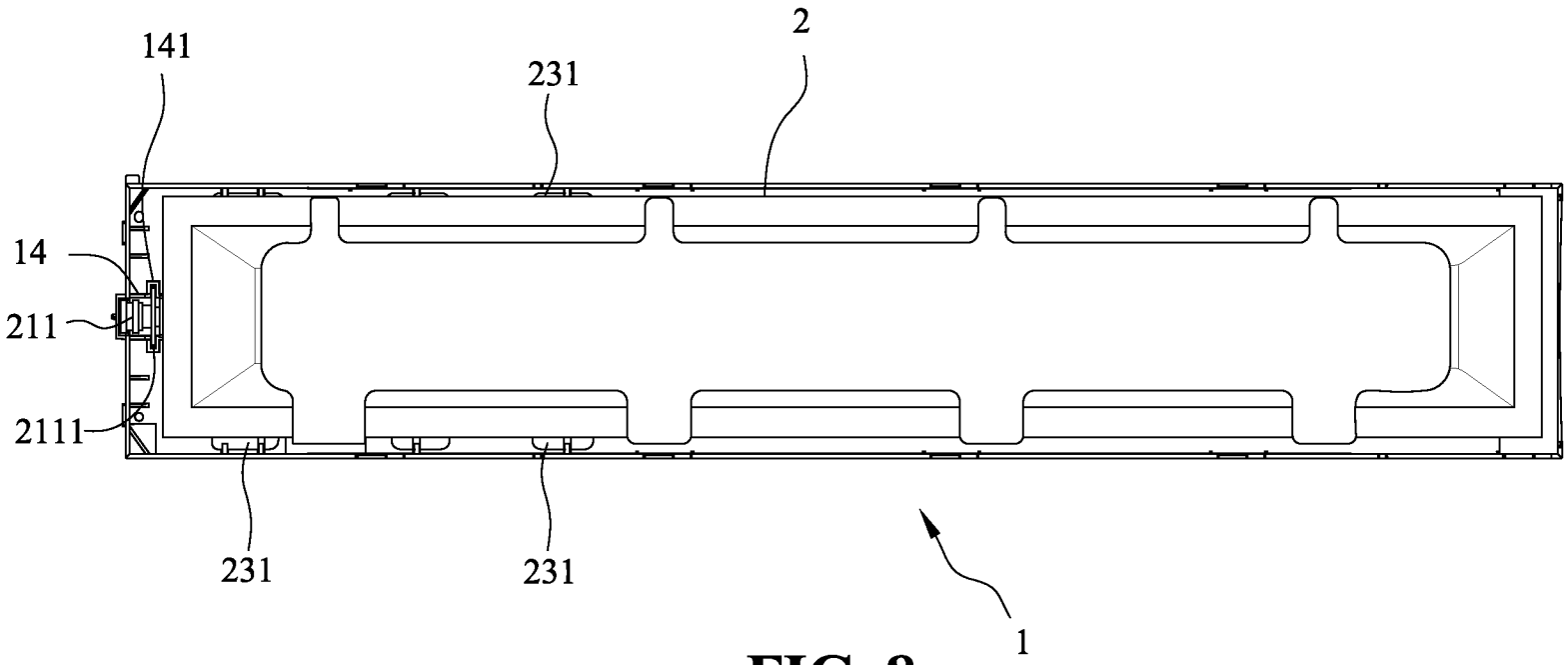
FIG. 8 shows a top view of the ink bag being retained after moving according to the resent invention.
Figure 9:
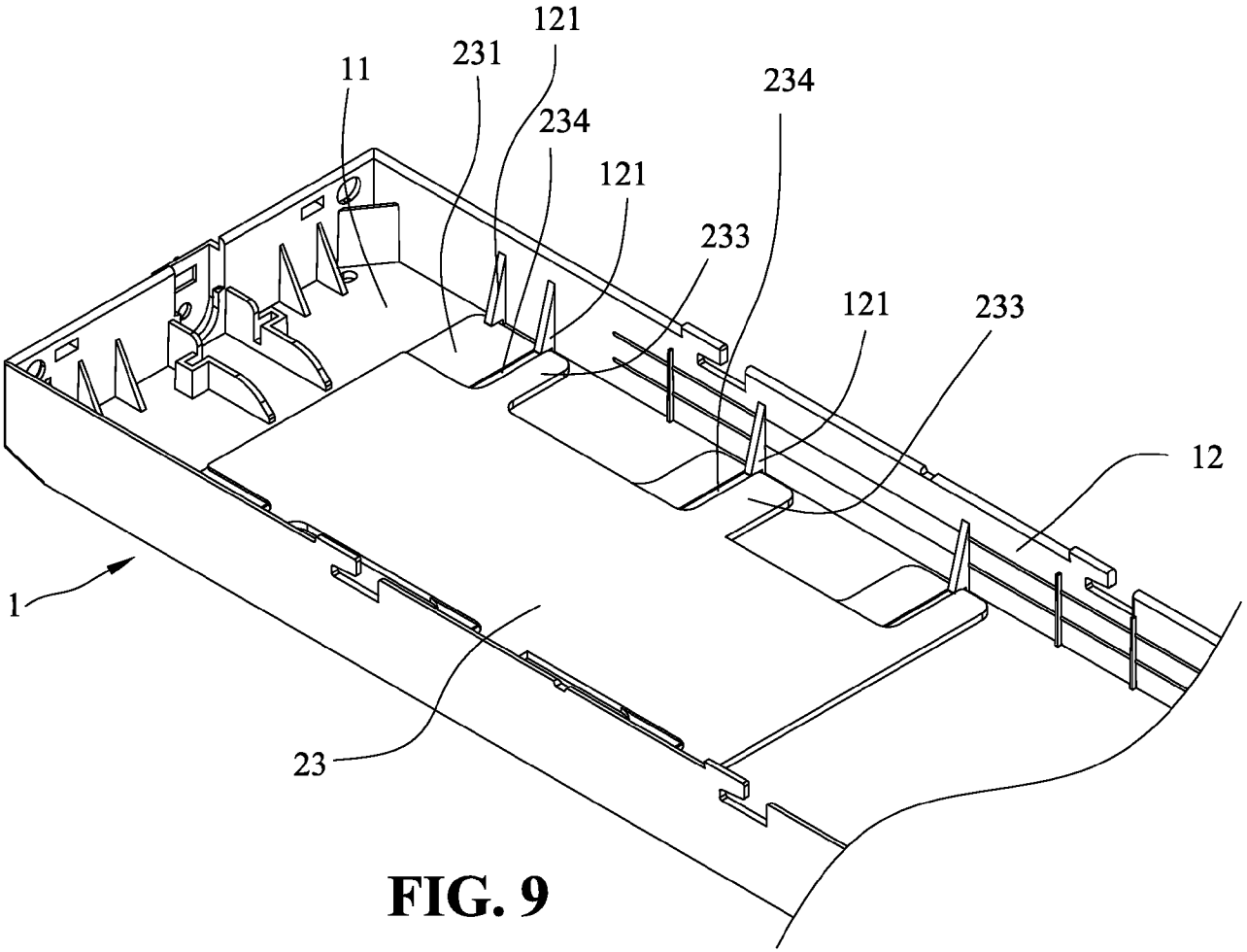
FIG. 9 shows a partially enlarged view of the positioning element being retained inside the cartridge body according to the present invention.

The following describes the actual use of the present invention. As shown in FIG. 6 and FIG. 7, when ink bag 2 is placed inside the cartridge body 1, the location of the notch 232 of the positioning element 23 corresponds to the location of the retention block 121 so that the ink bag 2 can be conveniently lowered into the cartridge body 1. When the positioning element 23 fits the inner bottom 11 of the cartridge body 1, the ink bag 2 is slid towards the direction of base 14 inside the cartridge body 1. At this point, the positioning element 23 moves laterally so that the retention element 231 inserts between the retention block 121 and the inner bottom 11 (as shown in FIG. 8 and FIG. 9). Finally, the stop block 233 stops the positioning element 23 from moving further. At this point, the retention block 121 enters the positioning trench 234 and is temporarily fixed. Then, the ink supply connector 211 of the ink bag 21 is installed to the inside the base 14. In other words, the protruding piece 211 inserts into the engaging notch 141. Finally, the lid body 3 is placed over the opening of the cartridge body 1 so that the ink bag 2 is placed and fixed correctly inside the rectangular container formed by the cartridge body 1 and the lid body 3.

Furthermore, during printing, the ink amount trigger 22 will lower as the amount of remain ink decreases. When running out of ink, the touch piece 221 will trigger the sensor of the printer so that the printer can display a message to alarm the user for replacing the ink bag.

To retrieve the ink bag 2, the above placement process is reversed: opening the lid body 3; disengaging the ink supply connector 211 from the base 14; sliding the retention piece 231 of the positioning element 2 off the retention block 121; and retrieving the exhausted ink bag 2 and placing a new ink bag 2.

In summary, the present invention glues both sides of the bag body 21 of the ink bag 2 to the ink amount trigger 22 and the positioning element 23, respectively, to become a replaceable ink bag. The ink cartridge is fixed by using removable engagement between the positioning element 23 and cartridge body 1 so that the exhausted ink bag 2 can be retrieved and replaced. As such, the ink cartridge with a replaceable ink bag having an ink amount trigger 21 can be easily replaced, and the cartridge body 1 and the lid body 3 can be reused to save the cost as well as resources to reduce the environmental waste.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A replaceable ink bag, comprising an ink amount trigger, a bag body and a positioning element, the bag body being a bag container with changeable shape, filled with ink, the bag body further comprising a first bag surface and a second bag surface, disposed oppositely, the first bag surface being partially glued to the ink amount trigger, the ink amount trigger moving towards a predefined direction as the amount of remaining ink decreasing; the second bag surface being partially glued to the positioning element.

2. The replaceable ink bag as claimed in claim 1, wherein a long side of the ink amount trigger is disposed with a downward touch piece, and the touch piece will not contact the positioning element in the downward moving path.

3. The replaceable ink bag as claimed in claim 1, wherein the surroundings of the positioning element is disposed with at least a retention element; when assembled, the retention element is stuck inside a cartridge body of a matching ink cartridge.

4. The replaceable ink bag as claimed in claim 3, wherein the two opposite long sides of the positioning element are disposed respectively with at least a retention element.

5. An ink cartridge with replaceable ink bag, comprising: a cartridge body, an ink bag and a lid body; wherein:

the cartridge body being a hard-shell container with an opening; inner walls on long side of the cartridge body comprising at least a retention block, a gap existing between the retention block and an inner bottom of the cartridge body;

the ink body further comprising an ink amount trigger, a bag body and a positioning element; the bag body being a bag container with changeable shape, filled with ink, the bag body further comprising a first bag surface and a second bag surface, disposed oppositely, the first bag surface being partially glued to the ink amount trigger, the ink amount trigger moving towards a predefined direction as the amount of remaining ink decreasing; the second bag surface being partially glued to the positioning element; surroundings of the positioning element having at least a retention element; when assembled, the retention element being inserted between the retention block and the inner bottom for fixing the ink bag inside the cartridge body; and the lid body being removably engaged to the cartridge body for opening and closing the opening of the cartridge body.

6. The ink cartridge with replaceable ink bag as claimed in claim 5, wherein the cartridge body is a long rectangular container, each of two inner walls on long side comprises at least a retention block and each of two opposite sides of the positioning element also comprises at least a retention element; when assembled, the retention element is inserted between the retention block and the inner bottom.

7. The ink cartridge with replaceable ink bag as claimed in claim 5, wherein the inner wall on long side comprises a plurality of retention blocks disposed with interval; the positioning element comprises at least a notch on two opposite long sides, the notch is located correspondingly to the location of the retention block so that the ink bag can be lowered into the cartridge.

8. The ink cartridge with replaceable ink bag as claimed in claim 5, wherein the retention element further comprises a stop block, with thickness larger than the gap between the retention block and the inner bottom.

9. The ink cartridge with replaceable ink bag as claimed in claim 5, wherein the retention element further comprises a concave engaging notch, for temporary fixing the retention block when assembled.

10. The ink cartridge with replaceable ink bag as claimed in claim 5, wherein a base is disposed inside the cartridge body, the bag body comprises an ink supply connector, the base has a shape matching the ink supply connector for fixing the ink supply connector when assembled.

* * * * *

UNITED STATES PATENT AND TRADEMARK OFFICE

CERTIFICATE OF CORRECTION

PATENT NO. : 8,807,724 B2
APPLICATION NO. : 14/063419
DATED : August 19, 2014
INVENTOR(S) : Yi-ching Lu et al.

It is certified that error appears in the above-identified patent and that said Letters Patent is hereby corrected as shown below:

On the Title Page item (72) Inventors should read: Yi-ching Lu, Hsinchu (TW)
Ming-Chung Peng, Hsinchu (TW)
Yun-Hsuan Chen, Hsinchu (TW)

Signed and Sealed this
Twenty-fifth Day of November, 2014

Michelle K. Lee

Michelle K. Lee
*Deputy Director of the United States Patent and Trademark Office*